US012247351B2

(12) United States Patent
Greene

(10) Patent No.: US 12,247,351 B2
(45) **Date of Patent: *Mar. 11, 2025**

(54) SYSTEM AND METHODS FOR LIVE AREA PRINTING FOR DARK COLORED TEXTILES HAVING NOVEL COLOR-MATCHING CHARACTERISTICS

(71) Applicant: Daniel Greene, Denver, CO (US)

(72) Inventor: Daniel Greene, Denver, CO (US)

( * ) Notice: Subject to any disclaimer, the term of this patent is extended or adjusted under 35 U.S.C. 154(b) by 51 days.

This patent is subject to a terminal disclaimer.

(21) Appl. No.: 18/003,834

(22) PCT Filed: Sep. 22, 2020

(86) PCT No.: PCT/US2020/051992

§ 371 (c)(1),
(2) Date: Dec. 29, 2022

(87) PCT Pub. No.: WO2022/005501

PCT Pub. Date: Jan. 6, 2022

(65) Prior Publication Data

US 2023/0257935 A1 Aug. 17, 2023

Related U.S. Application Data

(63) Continuation of application No. 16/918,073, filed on Jul. 1, 2020, now Pat. No. 12,000,085.

(51) Int. Cl.

| | |
|---|---|
| ***D06P 5/30*** | (2006.01) |
| ***D06B 11/00*** | (2006.01) |
| ***D06P 5/20*** | (2006.01) |

(52) U.S. Cl.
CPC ..... *D06P 5/30* (2013.01); *D06B 11/0059* (2013.01); *D06B 11/0076* (2013.01); *D06P 5/2077* (2013.01)

(58) Field of Classification Search
CPC .. B41M 5/0052; B41M 5/0094; B41M 5/035; B41M 2205/02; D06B 11/00;
(Continued)

(56) References Cited

U.S. PATENT DOCUMENTS 5,090,056 A 2/1992 Stoner et al.
12,000,085 B2 * 6/2024 Greene ..... D06P 5/30
(Continued)

FOREIGN PATENT DOCUMENTS

WO WO-2018222710 A1 * 12/2018 ..... B41F 16/0046

OTHER PUBLICATIONS

International Search Report and Written Opinion in International Applicatio No. PCT/US20/51992, dated Feb. 1, 2021, 19 pages.

*Primary Examiner* — William P Fletcher, III
(74) *Attorney, Agent, or Firm* — Berg Hill Greenleaf Ruscitti LLP

(57) ABSTRACT

A method for live area printing for textiles includes bulk production of textile blanks having uncolored live areas incorporated thereupon. The live areas are disposed at exact positions upon the blank to correspond to a specific location upon each textile article manufactured from the blank. Manufactured textile articles are thence customizable by printing directly to the live area(s) upon demand. Color is matched using methods based on CIELAB to ensure a seamless transition between the textile article color and the background color applied to the live area.

21 Claims, 11 Drawing Sheets

(58) Field of Classification Search
CPC ..... D06B 11/0056; D06B 11/0073; D06B 2700/04; D06B 2700/36; D06P 5/00; D06P 5/004; D06P 5/12
See application file for complete search history.

(56) References Cited

U.S. PATENT DOCUMENTS

| | | | | |
|---|---|---|---|---|
| 2004/0252173 | A1* | 12/2004 | Ben-Zur | B41J 3/4078 347/101 |
| 2016/0059622 | A1 | 3/2016 | Orcutt | |
| 2018/0125139 | A1 | 5/2018 | Ruppert-Stroescu et al. | |

* cited by examiner

SYSTEM AND METHODS FOR LIVE AREA PRINTING FOR DARK COLORED TEXTILES HAVING NOVEL COLOR-MATCHING CHARACTERISTICS

CROSS REFERENCE TO RELATED APPLICATION

This application is a national stage application under 35 U.S.C. 371 of PCT Application No. PCT/US20/51992 having an international filing date of Sep. 22, 2020, which designated the United States, which PCT application claimed the benefit of U.S. application Ser. No. 16/918,073, filed Jul. 1, 2020, both of which are incorporated by reference in their entireties.

TECHNICAL FIELD OF THE INVENTION

The present invention relates to a method for live area printing for textiles that enables customizable over-printing to garments and articles created from specially produced textile blanks, preferably textile blanks made predominantly of polyester. The blanks are produced having one or more live areas incorporated thereupon as a specified zone for the addition of a printed image or design subsequently rendered upon a neutral colored, white, or bleached white, background. The blanks are producible in bulk as dark colored textiles, or textiles incorporating multicolored design elements throughout, with the exception of the live area(s). Blanks are producible at quantity, with the live areas located appropriately for the incorporation of the customizable image(s) onto the finished article. The live area presents a neutral background upon which to set off single-run over-printing of the desired image or design upon demand, with the background properly matched to the color or design of the blank. The need of an additional process to neutralize the background color is obviated.

The present method therefore enables color matching between the live area and the colored blank without the need of a printed overlay, chemical overlay, or treatment to produce a neutral backing upon which the color must adhere or the ink must be bound. As a result, although the present method is usable with any printing method known in the art, including digital printing, manual application of disperse dyes using sublimation is specifically enabled whereby an image is loosely bound in polyester and other textile fibers receptive to disperse dyes to ensure vibrancy and longevity of the image or design with extended use. The present method therefore enables over-printing customizable images onto a variety of textile articles of different shapes and sizes. A single printer—devised for printing onto a range of sizes of sublimation transfer papers only, for example—is all that is needed to print across a range of textile articles for which different printers, treatments, and/or inks would otherwise be required, reducing the need for expensive equipment and enabling production of customized or personalized textiles and other garments producible upon demand. Further, use of consistently sized live areas across textile articles enables an efficient method of producing a customized article, consistent production parameters, and printing of matched articles from a single uploaded image or order entered. The present method therefore reduces the costs of customizable printing and creates a vibrant, long-lasting textile and/or article producible on demand in either short or long runs.

BACKGROUND OF THE INVENTION

Generally speaking, digital printing to textiles is preferable to silk screening because each item can be customized or personalized using automated workflows, the printing process can be programmed to use ICC (International Color Consortium) color profiles to control color accuracy and greatly reduce color variability, and the RIP (raster image processor programs), used to send image data to the printer, allow accurate metering of ink and exact determinations of cost. Silk screening requires more time, is more complex and involves setup of the press for each run, and repeated print runs so that independent layers may be added to build up a composite image by a layering of colors to ensure the full spectrum of colors is properly represented in the printed image. Significant downtime is thereby required as the press is set for each run, thereby limiting output by making customization and personalization time consuming and not cost-effective. Digital printing, on the other hand, allows for a digital image to be sent to a printer application as individual pixels are converted to dots of ink to build an image in a single print run to a specified and controlled color or pattern. Over-printing, printing a second image on a textile that was previously printed or colored, on a dark colored textile is complicated because the over-print colors will be modified by the background color if it is not white. Therefore, creating exact colors, and matching exact coloration across a textile weave when over-printing, can be problematic.

To address this problem, contemplations in the prior art tend to rely on use of an additional substance, such as titanium dioxide for example, to first fix a white background to the textile and then immediately superimpose ink to set off the design element being printed. This ensures exact color representation but increases the expense of digitally printing directly to textiles. It also increases the time of the print run substantially since an overlay is first applied to the textile and then the printed image superimposed thereatop. The use of titanium dioxide, binders, and other substances to create the neutral color bed for the ink to adhere to also tends to substantially negatively impact the maintenance costs and useful lifespan of digital printheads required in digital printing. Further, printing atop a fixed substance maintains the image only superficially upon the textile fibers whereby the permanence and vibrance of the image upon the textile is impacted and diminished with extended use.

Sublimation, on the other hand, enables the transfer of an image from an ink carrier, such as a transfer paper whereon the image is first printed as a mirror image using an ink that is a fine dispersion of water, dispersing agent, stabilizing chemicals, and disperse dye. The ink is transferred using a process generally known as sublimation whereupon the transfer medium is brought into contact with the textile under pressure and heat. The heat vaporizes the disperse dye creating a gas that condenses onto and penetrates into the polyester textile fibers. Disperse dyes fill the voids of receptive polymer materials such as polyester, cellulose acetate, nylon, acrylic, and other receptive synthetic fabric. Pressure and heat, typically at 400° F., is used to both to temporarily make the voids highly receptive to the ink and to propel or diffuse the ink itself. The diffused dye is held in place in receptive material by Van Der Waals' force which are weak. The bond caused by sublimation is more thorough than silk screening or digital printing of a pigment that is bound to the outer surface of the textile by a binder, typically an adhesive. Pigment particles on fabric are subject to mechanical action which causes them to crock off. The binder will also weaken over time, causing the pigment to release from the textile. As a result, sublimation is preferable for creating long-lasting printed designs on polyester textiles.

However, the above issues persist in creating a vibrant color match, especially when printing upon dark colored textile blanks at different times. Sublimated colors will be darkened by the overlapping application of sublimated ink superimposing upon already colored areas of the textile. This makes creating a constant color, defined by a corresponding constant lightness, chroma, and hue (LCH) across the textile using an over-print, challenging for separate printing on a single textile, as when customizing textiles or producing textiles upon demand. Most dyes used for sublimation printing are disperse dyes belonging to the subclass of disperse dyes having small low polarity molecules. There are over 1000 disperse dyes but only 9 belong to the subclass of disperse dyes having small low polarity molecules suitable making them ideal for use with transfer media such as paper coated to hold the dyes on the surface of the paper. These 9 dyes are often referred to as sublimation dyes. Technically, they are referred to as low energy disperse dyes because they require a minimum amount of heating time to diffuse and be absorbed into the fabric. Because sublimation dyes diffuse rapidly, they can be printed to paper and then transferred from paper into fabric using heat and pressure. However, disperse dyes with larger molecular sizes and moderate polarity, known as medium and high energy disperse dyes, such as fluorescent disperse dyes, can often be used successfully for sublimation with adjustments to the time, temperature, and pressure of the dye transfer process. In general, sublimation dyes produce brilliant, saturated color when transferred to a receptive medium.

As a result of the limited number of sublimation-compatible dyes, there is no true black disperse or sublimation dye. Black ink is created by mixing other colors of disperse dyes such as blue, red, and brown. The color of black ink will vary by manufacturer and product. Other colors are created by mixing cyan, magenta, and yellow disperse dye. Unlike pigments, dyes will shift hues as their concentration increases. For example, low energy cyan disperse dye changes hue from cyan to blue and then to purple as it is concentrated. Moreover, textiles are not isotropic and do not have a consistent white point. For these reasons, there is no standard or consistent formula creating sublimation colors. A disperse or sublimation dye that appears to be deep and neutral black on one material may appear light or non-neutral on another material. As a result of these shortcomings, it is be difficult to achieve efficient color-matching between an image or design over-printed by sublimation onto a previously colored textile; for example, overprinting an image surrounded by black onto a black, or substantially black textile.

The present invention, therefore, seeks to address these and other issues by enabling bulk production of textile banks having a neutrally colored live area, such as a white or bleached white live area, disposed thereupon in a particular location corresponding to a particular position upon the finished textile article fabricated from the blank, whereby individual and customizable images are printable to the live area once the garment or textile has been manufactured into its wearable or final form, without having to first print an overlay to set-off the color scheme or ensure color matching between the live area and the surrounding, pre-printed or dyed textile. Notably, while discussion herein refers to a garment, it is understood that methods and techniques provided herein are applicable to other articles, such as footwear, equipment, and other articles formed with a sublimation-compatible material, such as polyester-based textiles. Therefore, it is contemplated that the term "garment" may be replaced with a generic term "article" throughout while maintaining the intended scope hereof. However, for discussion purposes, the term "garment" or "textile" is generally used for illustrative purposes.

The present invention, therefore, has been devised to create matched color between a subsequently live area and the pre-printed textile blanks, wherein the background color of the live area is matched to the textile blank and blended into the blank to render the live area indistinguishable from the remaining color of the garment or textile product. The present invention further includes novel methods to modify the textile color, and in particular black textile color, to be within the range of achievable black color generation possible on images or design having a black component or background that may be transferred onto, for example a live area of a textile through a sublimation printing process. Notably, as used herein, the term "Color Profile" or "Color Profiles" means the characterization of the color output space as defined by the International Color Consortium (color.org.) The CIELAB or CIE L*a*b* color space, commonly abbreviated as L*a*b*, is a model of the color space that was defined by the International Commission on Illumination (cie.co.at).

In certain preferred embodiments, blanks can therefore be produced in bulk to reduce costs while enabling the addition of unique or customized designs to a finished garment upon demand. Known sized live areas enable customizing textiles by use of less expensive print equipment, such as the use of transfer paper to sublimate the image onto the live area, requiring only a printer devised for use with the transfer paper, and not a printer equipped to print directly to the textile itself.

SUMMARY OF THE INVENTION

The present invention contemplates production of textile blanks with a designated live area incorporated. The term "live area", as used herein throughout, describes an area upon a textile blank having specific dimensions matched to a digital print module or sublimation process, as will be described subsequently. It should be noted that while silk screening onto the live area is possible, it is less desirable since the set-up time to run the required colors and layer-up the image increases time which the present invention is created to obviate. However, it should be noted that any method of printing to textiles is applicable for use with the current method.

The live area is contemplated to be a white, neutral, or uncolored portion of a dark textile blank, for example bleach white as rendered to textile blanks previous to the addition of color. The live area is positioned precisely upon the blank to correspond with a print area whereby a design can be printed therein after the textile article is manufactured; this is referred to hereinafter as "over-printed" or "over-printing." It should be noted that the entire live area can be over-printed at a later time with a customizable image, enabling cost-effective production of customized textiles on demand. Where the added design is sized interior to the live area, the surrounding live area ("background") is printed with a color matched to the particular color of the textile blank to thereby render a seamless transition between the textile color and the design element. Notably, as used herein, the term "exact" with respect to the color-matching properties of the current invention means the color transition from the textile to the image or design printed to the live area is not readily discernible by a human observer under typical indoor or outdoor lighting conditions. In one embodiment, color matching may be achieved by the use of feathered borders surrounding the live area that fade the textile color into the live area ensure very close color match between the live area and the surrounding blank is maintained, whereby a seamless transition between the live area and the surrounding color is affected. The result is a textile article that appears as if it was produced with the customized design or image originally incorporated. In another embodiment, color matching may be achieved by modifying the color of the underlying textile such that it is a color that is obtainable by digital dye-sublimation printing, for example, a black that has a CIELAB value of L* a* b* equal to 20, +0.50, −4.00. In this manner, the color match between the live area and the surrounding blank is maintained.

It should further be noted that, at initial production of the blanks, live areas may be produced upon any area of the textile blank suited for rendering a design at a particular position upon a person wearing the textile or displaying the finished article. Thus, blanks cut for the creation of T-shirts, for example, may have repeating live areas disposed at specific locations along the blanks corresponding with a design location desired for a particular T-shirt. Generally, live areas are produced on textile blanks in positions corresponding to the chest or breast area of the final T-shirts produced from the blank and/or upon the back of the T-shirts produced from the blank. However, it should be recognized by persons of ordinary skill in the art that the same concept of situating live areas in repeating fashion along a textile blank can correspond with differing design placements, as desired, including designs rendered along sides of a T-shirt produced from the blank, for example, or, where desirable, multiple live areas may be produced along the textile blank to render clothing or articles having multiple design placements thereon. Thus, live areas appropriate for customized sleeves, breasts, backs, sides, seams, pockets, or live areas disposed anywhere capable of receiving a design element upon the finished article, are contemplated as part of the scope of this invention.

Further, as is readily comprehensible to persons of ordinary skill in the relevant art, such live areas are producible upon blanks of textiles used for all garment types (including, for example, hats and headwear, shirts, T-shirts, pants, underwear, trousers, gloves, etc.) as well as for textiles that are not intended as garments per se, but as other textile articles including, for example, towels, pillows, rugs, throws, tapestries, fabric for furniture upholstery, etc. The general purpose of the present invention, then, is to allow the scaled production of blanks to create finished textile articles and garments which may be later customized with unique design elements upon demand. This lowers cost of production considerably, by enabling scaled, bulk production of the blanks and mass-production of the articles, while minimizing the expense of adding a customized design element individually printed at a later time. Textile blanks are therefore produced for particular articles, including garments, upholstery, and other textile articles. Live areas are produced at time of manufacturing the blanks with exact placements upon the associated blank to correspond to particular positions upon the finished article rendered from the blank. The blank is therefore measured at precise intervals corresponding with location coordinates to ensure proper placement whereby the finished article is produced with the live area situated appropriately for incorporation of the later added-design element(s) or image(s).

It should be noted that the border of the live area may be feathered at the time of manufacturing the blank, to fade the color of the textile into the live area a given distance. In this embodiment, the blank may be rendered having a color within the range afforded by digital dye sublimation and required to ensure a match of the sublimated image subsequently applied to the live area. For example, in an example embodiment described herein, the blank may be rendered using black ink at a L* a* b* equal to 21, +1.00, −5.00, (which is within the range afforded by sublimation and required to ensure a match of the sublimated image subsequently applied to the live area) and feathered from CIELAB L* value of 21 to L* 100 over a distance of not more than two inches. Notably, the use of black in this example is arbitrary unit and may encompass any color that may be achievable by sublimation. When rendering the added design applied to sublimation transfer paper, for example, an inverse, complementary feather may be incorporated, to overlay the feathered border proportionately to ensure a continuous color is applied to fade the image into the surrounding textile whereby a seamless transition is effectuated between the design applied to the live area and the surrounding colored textile article. Thus, an accurate match to L* a* b* equal to 21, +1.00, −5.00 as defined subsequently surrounds the finalized image or design applied to the live area that seamlessly blends transition from the live area into the color of the textile whereby a perceived color match is therefore maintained.

The present method for live area printing for textiles further enables customizable printing upon demand. Because the live area is of predetermined dimensions, corresponding transfer paper sizes are usable to sublimate a customized image, submitted, for example, online. An end user may, therefore, upload an image file through an online portal for production upon a customized textile article. Once the image is uploaded, a single print run may produce the mirror-image upon the appropriate transfer paper for sublimation to the article. Thus, customizable printing is possible on demand at low cost. For example, consider a school sports team that uses the same colored shirts, or patterned design, but the name and number upon each shirt must vary for each player. Having textile blanks produced at scale for the team colors enables custom printing of the name and number into the corresponding live areas with background matched to the overall textile design without having to produce individual shirts at manufacture or print directly to the textile proper. Customizable team jerseys are therefore producible on demand at relatively low cost.

Thus, has been broadly outlined the more important features of the present method for live area printing for textiles so that the detailed description thereof that follows may be better understood and in order that the present contribution to the art may be better appreciated.

Additional embodiments of the invention may include one or more of the following preferred embodiments:

1. A method for live area printing for textiles comprising the steps of:

manufacturing a textile blank with white or uncolored live areas disposed at intervals set to present the live area in a specific location upon a finished textile article manufactured from the said textile blank;

printing a design or image upon the live area having a background color matched to the textile blank.

2. The method of embodiment 1, further comprising assembling the textile article from the blank.

3. The method of any of embodiments 1-2, wherein printing comprises printing a design or image upon the live area in a subsequent, single print run without the addition of a previously applied overlay required to set-off the ink.

4. The method of any of embodiments 1-3, further comprising wherein additional substances to bind, set, disburse, and/or contrast the ink to the textile article are unnecessary and customizable imagery or designs having a background color matched to the textile blank can be reproduced upon the textile blank live area on demand.

5. The method of any of embodiment 1-4, wherein said printing a design or image upon the live area comprises printing a design or image upon the live area by sublimation.

6. The method of any of embodiment 1-5, wherein said textile blank comprises a textile blank having a color equal to or greater than the minimum color density or saturation lightness achievable by sublimation printing, and wherein the color differential optionally comprises a color differential of no more than one Delta (ΔE*).

7. The method of any of embodiments 1-6, wherein the background of the design or image printed on the live area by sublimation compared to the textile blank includes the following parameters:

CIELAB ΔE* is less than 1.00;

ΔL* is less than 0.50;

Δa* is less than 0.50 and a* of both areas are positive; and

Δb* is less than 0.50 and b* is negative.

8. The method of any of embodiments 1-7, wherein said textile blank comprises a black textile blank having a black with CIELAB L* value equal to or greater than the minimum CIELAB L* achievable by sublimation printing 9. The method of embodiment 8, wherein said black textile blank comprises a black textile blank having a L* value greater than the L* value for the color black achievable by sublimation.

9. The method of any of embodiments 8-9, herein said black textile blank comprises a black textile blank having an L* value of 17 to 24.

10. The method of any of embodiments 8-9, herein said black textile blank comprises a black textile blank having a Live area that is digitally printed utilizing sublimation having an L* value between 17-24.

11. The method of any of embodiments 1-10, wherein the textile is manufactured from a high-heat extruded fabric.

12. The method of any of embodiments 1-11, further comprising the steps of:

producing said live area upon the textile blank with a feathered border having a fade from a minimum color lightness (L*), corresponding to the color lightness informing the textile blank, to a L* of 100 applied over a prescribed distance; and printing the image to the live area with an inverse feathered border configured to superimpose upon the feathered border of said live area, wherein an inverse fade superimposes upon the feathered border of the textile article to ensure a constant color lightness (L*) is maintained across the transition between said live area and the textile article;

whereby the background color of the live area is matched to the color of the textile article and the lightness of the color is equalized across the transition between the textile article and the live area.

13. The method of any of embodiments 1-2, wherein printing to said live area is performed by a digital printer.

14. The method of any of embodiments 2, wherein printing to said live area is performed by sublimation printing wherein a mirror-image of the design is first printed to a sublimation transfer paper sized to superimpose upon the live area.

15. The method of any of embodiments 1, 11 and 14 wherein the minimum color lightness applied to the textile blank is equal to or greater than the minimum color lightness achievable by sublimation printing, and wherein the color differential optionally comprises a color differential of no more than one Delta E* (ΔE*).

16. The method of embodiment 15, wherein the feathered border of the live area is matched with an inverse feathered border printed upon the sublimation transfer paper whereby the of a background of the live area is matched to the color of the textile blank upon sublimation of the printed design or image as measured by Delta L* (ΔL*), Delta Δa* and Delta Δb*.

17. A method for live area printing for textiles comprising the steps of:

producing a colored textile blank with at least one white or uncolored live area, said live area configured to specific dimensions matched to a live area digital print module operating upon a digital ink jet printer or sized to a corresponding transfer paper for sublimation printing;

producing the finished textile article from the blank such that the at least one live area is presented upon the textile article at a desired location for addition of a design or image printed to the at least one live area at a subsequent time; and printing a design or image directly onto the at least one live area in a single print run with a background color matched to the color surrounding the live area on the textile article without the need of additional substances applied to the textile to set the ink in contrast during the said print run;

wherein additional substances to bind, set, disburse, and/or contrast the ink to the textile blank are unnecessary whereby customizable imagery or designs having colors matched to the textile blank may be reproduced upon the textile blank live area upon demand.

18. The method of embodiment 17, further comprising the step of producing the live area upon the textile blank with a feathered border having a fade from a minimum color lightness, corresponding to the color lightness informing the textile blank, to a lightness value of 100 applied over a prescribed distance.

19. The method of embodiment 19, further comprising the step of printing a design or image to the live area with an inverse feathered border devised to superimpose upon the feathered border of the live area, wherein an inverse fade superimposes upon the feathered border of the textile article to ensure a constant color lightness is maintained across the transition between the live area and the textile article whereby the background color of the live area is matched to the color of the textile article and the lightness of the color is equalized to create a seamless transition between the textile article and the live area.

20. The method of embodiment 19, wherein the step of printing a design or image to the live area further includes the steps of:

printing the design or image in mirror-image to a sublimation transfer paper sized to superimpose over the at least one live area;

positioning the sublimation transfer paper superimposed upon the live area wherein the inverse feathered border of the transfer paper superimposes upon the feathered border of the live area to maintain a constant color lightness across each of the complementary fades; and applying heat to sublimate the design or image from the transfer paper into a weave of the live area.

21. The method of any of embodiments 17-20, wherein the minimum color lightness applied to the textile blank is equal to or greater than the minimum color lightness achievable by sublimation printing, and wherein the color differential optionally comprises a color differential of no more than one Delta E* (ΔE*).

22. The method of any of embodiments 17-21, wherein the background of the design or image printed on the live area by sublimation compared to the textile blank includes the following parameters:

ΔE* is less than 1.00;

ΔL* is less than 0.50;

Δa* is less than 0.50 and a* of both areas are positive; and

Δb* is less than 0.50 and b* is negative.

23. The method of any of embodiments 17-20, wherein said textile blank comprises a black textile blank having a black color lightness equal to or greater than the minimum black color lightness achievable by sublimation printing 24. The method of embodiment 23, wherein said black textile blank comprises a black textile blank having a CIELAB L* value less than CIELAB L* level for the color black achievable by sublimation.

25. The method of any of embodiments 23-24, herein said black textile blank comprises a black textile blank having a CIELAB L* value of 17-24 or less.

26. The method of any of embodiments 23-24, herein said black textile blank comprises a black textile blank having a CIELAB L* value between 17-24.

27. The method of any of embodiments 17-26, wherein the textile is manufactured from a high-heat extruded fabric.

Objects of the present method for live area printing for textiles, along with various novel features that characterize the invention are particularly pointed out in the claims forming a part of this disclosure. For better understanding of the method for live area printing for textiles, its operating advantages and specific objects attained by its uses, refer to the accompanying drawings and description.

BRIEF DESCRIPTION OF THE DRAWINGS

FIG. 5 shows the complementary fade disposed upon the transfer paper from a maximum black interior to the transfer paper to a white at the edge of the transfer paper which fade is devised to overlie the fade upon the garment to maintain a consistent color transition from the live area to the garment proper to match the color of the garment.

DETAILED DESCRIPTION OF THE INVENTION

With reference now to the drawings, and in particular FIGS. 1 through 9 thereof, example of the instant method for live area printing for textiles employing the principles and concepts of the present method for live area printing for textiles and generally designated by the reference number 10 will be described. Referring to FIGS. 1 through 9 a preferred embodiment of the present method for live area printing for textiles 10 is illustrated.

Figure 1:
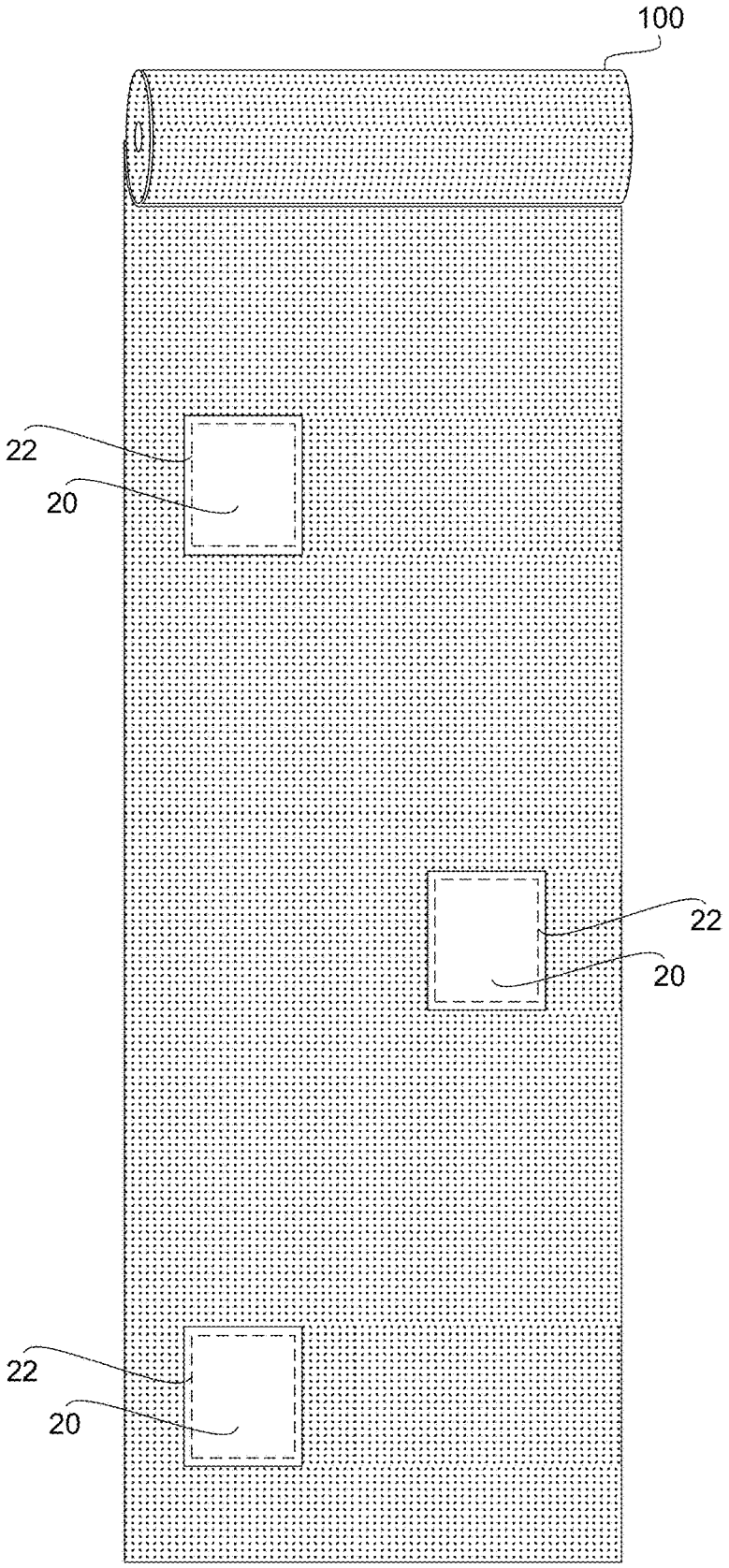
FIG. 1 is an elevation view of a textile blank having example live areas produced thereupon in exact position to correspond to the addition of a subsequently printed element into the live area.

Referring to FIG. 1, textile blanks 100 are produced with a live area 20 disposed at precise repeating intervals to correspond with a position upon each finished textile article 70. Printing of textile blanks 100 can be performed in any way known in the art, such as silk-screening for example, to mass produce the textile blank 100 of a desired color. Live areas 20 are created by preventing adherence of color to particular areas suited to the subsequent addition of a unique or customized design upon each finished textile article 70. Note that the textile blank 100 may be produced with any color pattern, including multicolored designs representative of particular teams (for example) or with corresponding designs, as desired.

The live area 20 is produced with a feathered border 22 that includes a fade 24 (see FIG. 4) from a maximum color, corresponding to the color of the surrounding blank 100, to white (no color), interior to the live area 20. The feathered border 22 is applied as a continuous fade 24 across a constant distance, for example across a two-inch gradient into the lie area 20. However, additional distances are contemplated as part of this disclosure, matched to the particular article and color intended for each particular blank 100.

Figure 2:
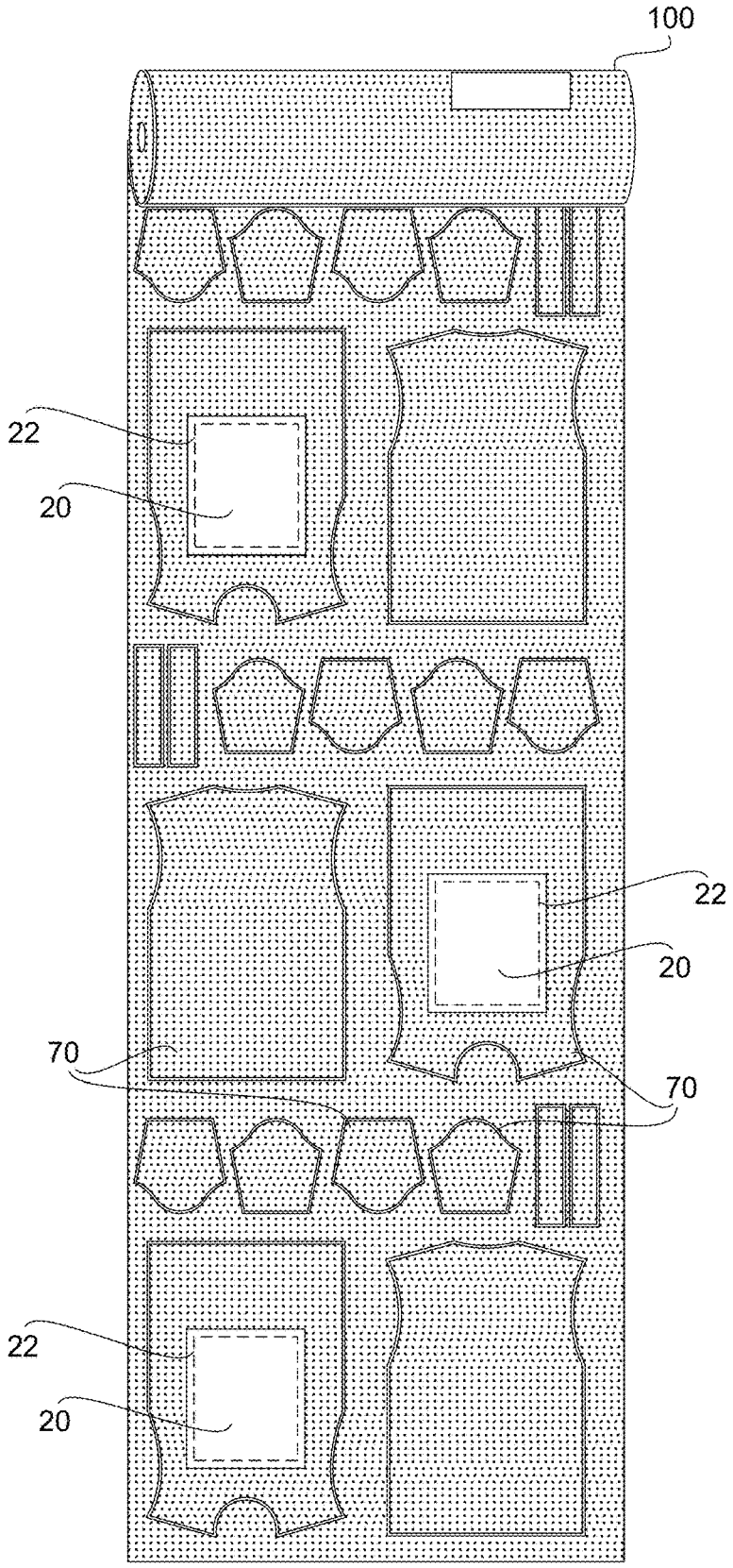
FIG. 2 is an elevation view of the textile blank showing the outlines for the garments as will be produced from the blank.
Figure 3:
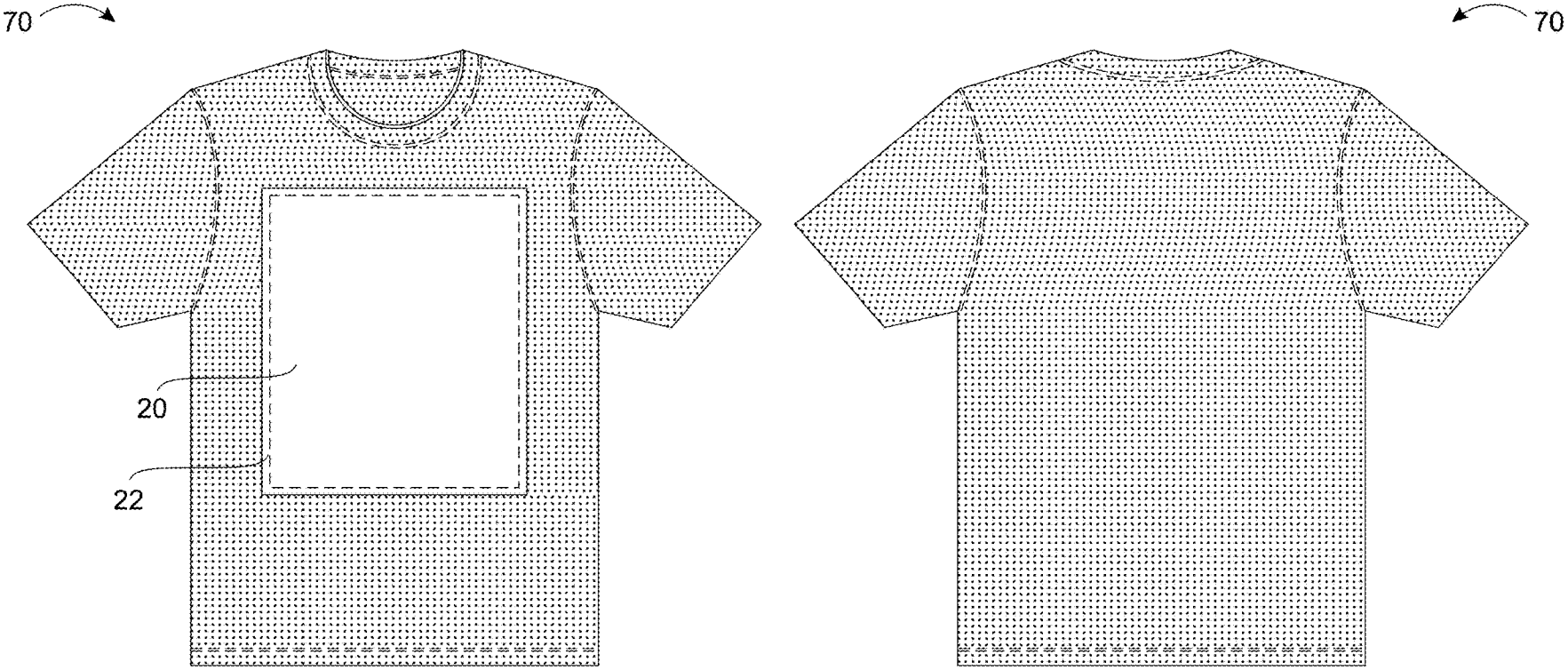
FIG. 3 is an elevation view of the front and rear of a T-shirt produced from the blank shown in FIG. 2 with an example live area disposed upon the breast.

Referring to FIGS. 2 and 3, textile blanks 100 are then cut and the finished article 70 is produced with the live area(s) 20 dispose at specific location(s) and determined size(s) that correspond to a digital print module or to specific sublimation transfer paper 30 sizes. Finished articles 70 are then shippable in bulk to retail or wholesale outlets whereat customizable printing to the corresponding live areas 20 is enabled on demand via a single print run with low-tech and/or smaller scale printing equipment for each order received. In the case of the example illustrated in FIG. 2, T-shirts are assembled with live areas 20 upon the breast. The backs of the T-shirts are blank. The finished article 70 assembled from the blank 100 is shown in FIG. 3. In such an example embodiment, an image may thence be printed to the breast of each finished T-shirt upon demand, with the image background exactly matched to the color of the blank 100, even where the blank color is a dark color or even multicolored, such as where the T-shirt is produced with a particular multicolored design or when showcasing colors devised to represent a particular sporting team, say.

Figure 4:
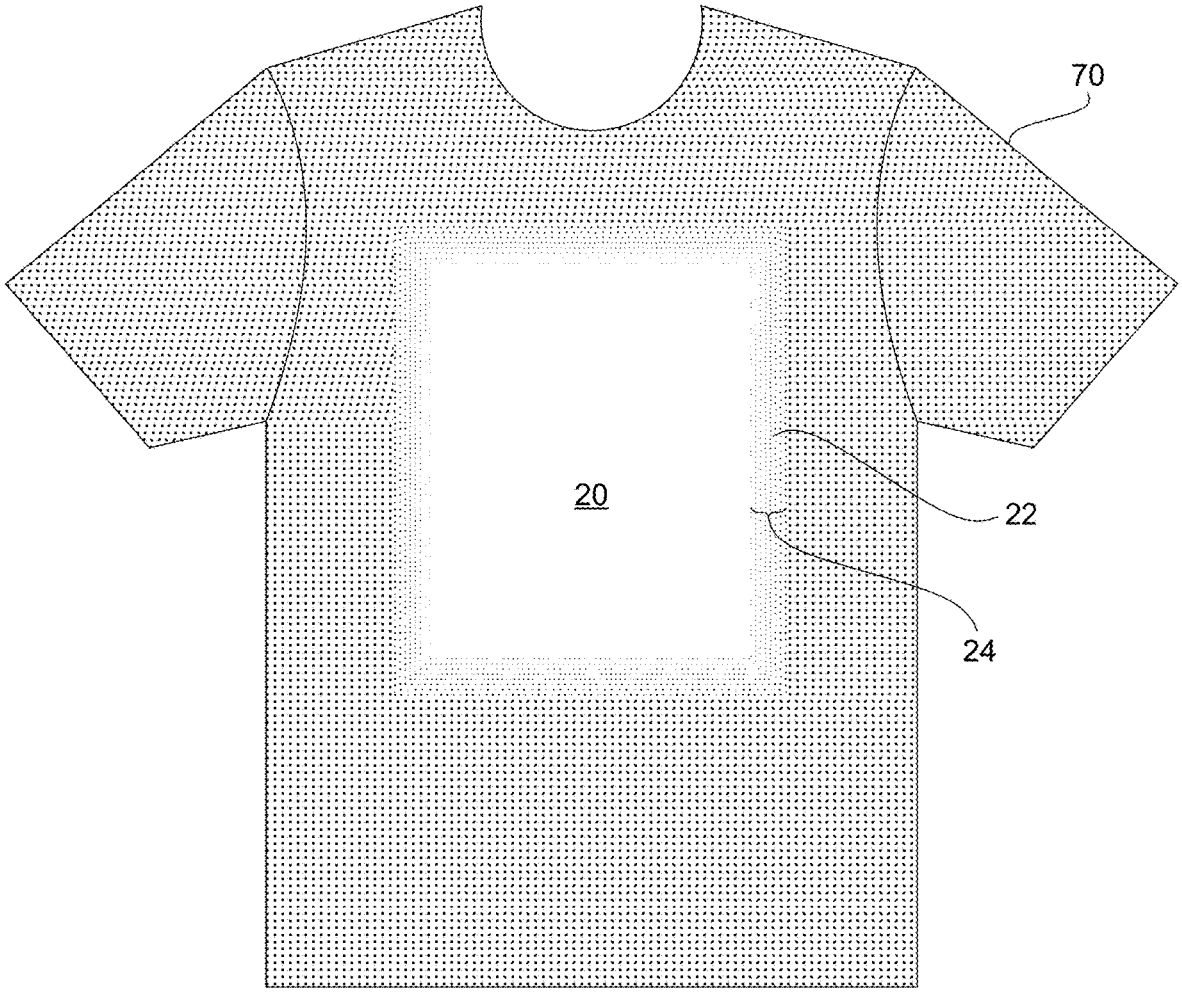
FIG. 4 is a detail view of the example live area disposed upon a T-shirt produced from the blank shown in FIG. 2 illustrating a fade from the colored garment into the live area, from a maximum black to white across a specific distance into the live area to ensure a matched color across the printed live area when an image is subsequently printed thereto.
Figure 5:
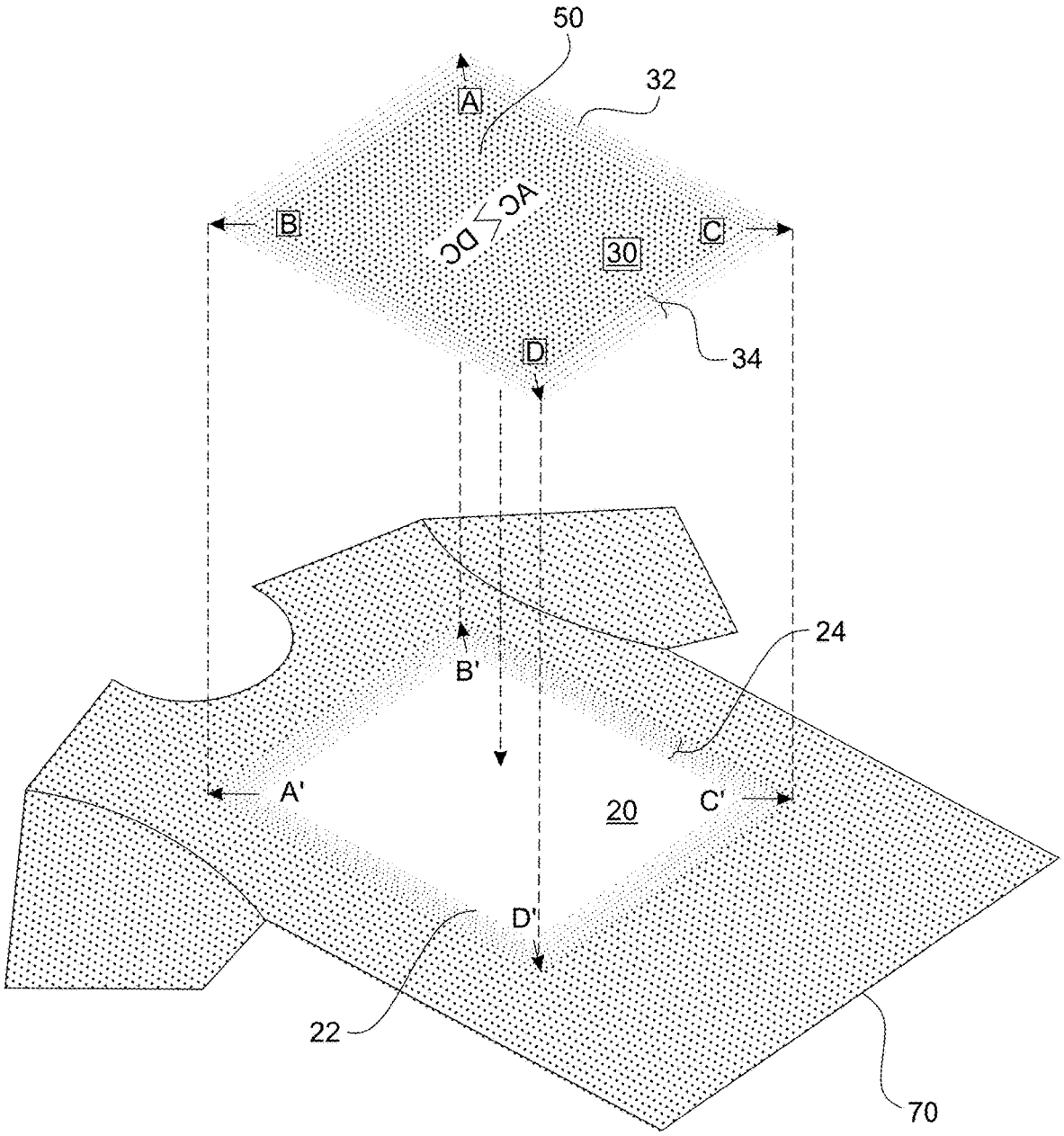
FIG. 5 is a diagrammatic view of a transfer paper for creating an individualized design upon the live area of the garment.

FIG. 4 is a detail view of an example embodiment of a feathered border 22 surrounding the live area 20. In this instance, the border 22 is feathered along a fade 24 from a color matched to the color of the produced blank 100 down to white (no color) within the live area 20 across a distance of at most two inches. As is shown in FIG. 5, an image or design element 50 printed to sublimation transfer paper 30 includes an inverse feathered border 32 devised to superimpose upon the feathered border 22 and produce a constant color that blends the transition between the live area 20 and the surrounding textile article 70. In the example embodiment depicted using black as the background color, the maximum color of the textile 70, produced upon the blank 100 is contemplated to be have a CIELAB L* value of 20 which is about 2% less than the maximum achievable CIELAB L* value applicable to textiles using a digital sublimation process. In this example embodiment, this minimum CIELAB L* is greater than the minimum achievable color CIELAB L* value to ensure a match is rendered between the image applied to the live area 20 and the textile blank 100 during sublimation printing to the live area 20. Thus, the feathered border 22 produced upon the textile surrounding the live area(s) 20 continuously fades from an CIELAB L* of 20 to an L* of 100 with the a* and b* values remaining approximately constant over a maximum of two in inches. Printing of a complementary feathered border 32 that superimposes an inversely disposed fade 34 (from CIELAB L*=20 to L*=100 but in the opposite direction) therefore ensures a color match consisting of, in this illustrative example, L*=20 throughout to prevent an appearance of an outline surrounding the live area 20 after an image or design has been applied to the live area 20. Thus, the complementary fades 24 and 34 superimpose and create a continuous transition of color from the live area 20 to the garment proper to render a constant color with a match based on CIELAB throughout so as not to be noticeable to the human eye.

FIG. 5 illustrates a sublimation transfer paper 30 with a mirror-image of a design element 50 printed thereupon for sublimation to the live area 20 upon the textile article 70. The inverse feathered border 32 bounding the mirror image 50 is printed to superimpose upon the feathered border 22 bounding the live area 20 to ensure a consistent color is maintained across the transition between the textile 70 color and the color of the live area 20. Corner A of the transfer paper is aligned exactly to corner A' of the live area, corner B of the transfer paper is aligned exactly to corner B', corner C of the transfer paper is aligned exactly with corner C' of the live area, and corner D of the transfer paper is aligned exactly with corner D' of the live area. Superimposition of the transfer paper 30 upon the live area 20 ensures the complementary feathered borders 22, 23 superimpose to maintain the constant color match across the complementary fades 24, 34.

As discussed above, in this example embodiment herein illustrated, the maximum color is contemplated have a CIELAB L* value of 20, which is feathered to a CIELAB L* value of 100 into the live area 20 upon the textile 70 along a continuous two inch fade 24, and the inverse feathered border 32 runs in the opposite direction along the same continuum to ensure a constant CIELAB value throughout. It should be noted by persons of skill in the art that additional color are contemplated across a spectrum of colors and color combinations and multi-colored designs; the essential concept being the match of the complementary feathered border 32 of the transfer paper that superimposes upon the feathered border 22 of the live area 20 to ensure a consistent color is applied whereby the transition between the design on the live area 20 and the surrounding textile color is seamlessly matched.

In this example embodiment, wherein the live area 20 is printed via sublimation, maximum color are controlled by the minimum achievable color CIELAB L* value for the given hue and chroma values enabled by digital dye sublimation. Where digital printing is used to print to the live area 20 directly, the inverse feathered border 32 may be applied directly to the textile 70 during printing of the live area 20 whereby colors are matched between the color produced upon the textile blank 100 and the printed live area 20 at the time of actually printing the image or design directly to the live area 20. A seamless transition, therefore, between the color of the textile blank 100 and the live area 20 is ensured and visible outlines, borders, or discontinuities between the live area 20 and the textile 70 are avoided while a unique or customized design is applied to the live area 20 rendering a unique textile product or garment that is producible upon demand.

Figure 6:
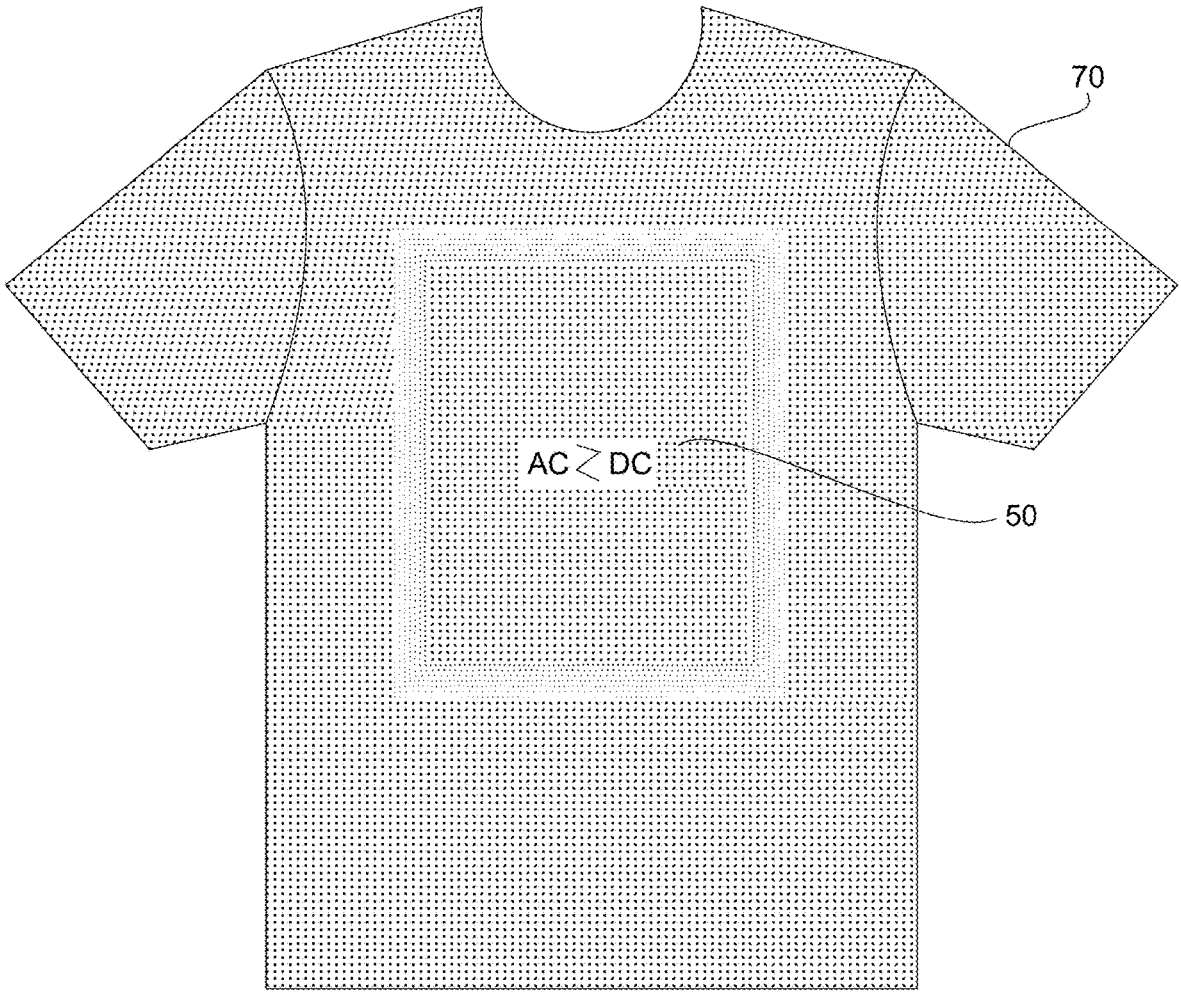
FIG. 6 is an elevation view of a T-shirt with the unique design applied to the live area.

FIG. 6 illustrates the textile article 70 (in this example. a T Shirt) with a customized image printed to the live area 20. A seamless transition between the live area 20 and the textile 70 is created by the superimposition of the complementary fades 22, 24 comprising the feathered borders 24, 34 during the printing upon demand.

Figure 7:
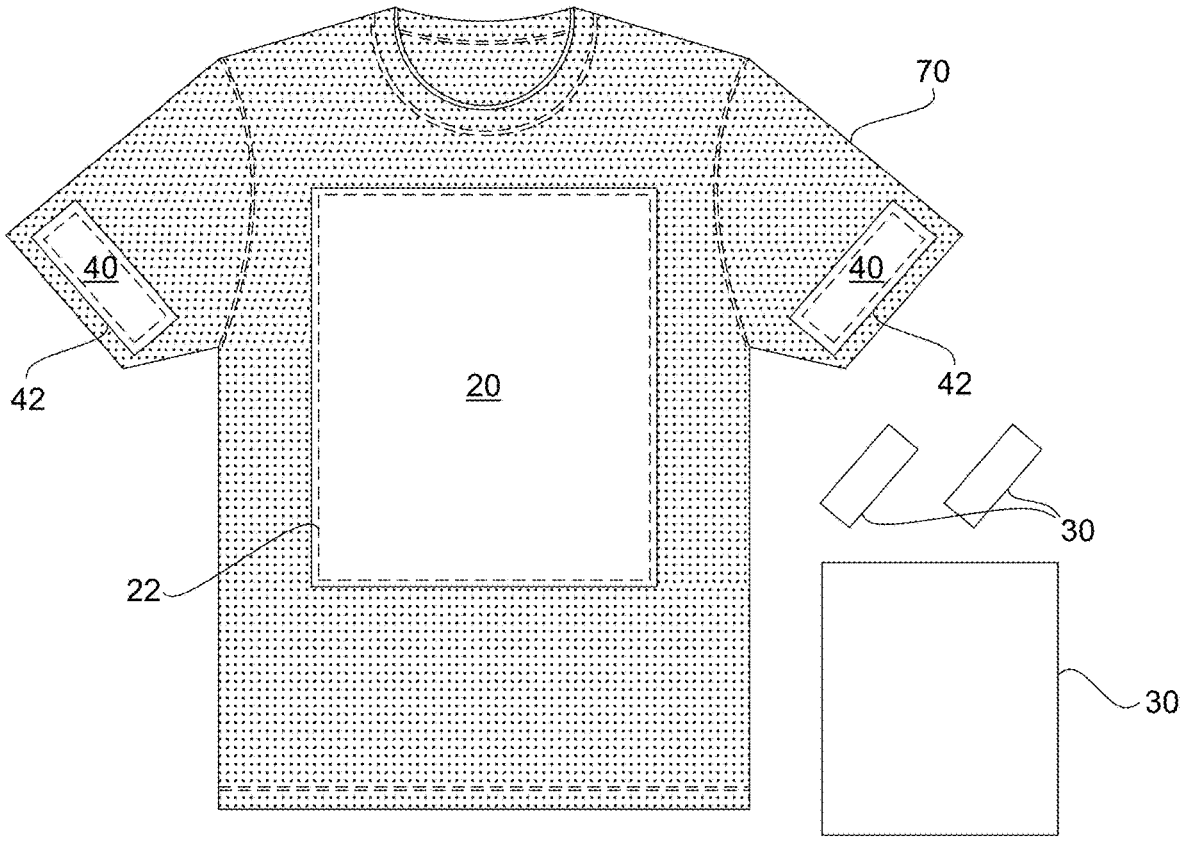
FIG. 7 is an elevation view of a garment produced having an example of a plurality of live areas at key places on the design suitable for the addition of a unique or customized design.

FIG. 7 illustrates an example embodiment of a textile 70 produced from a blank 100 for creating T-shirts and having additional live areas 40 of known dimensions disposed upon, in this example, the sleeves of the textile 70 for the receipt of additional customizable design elements, as may be desired when producing unique and customized textiles upon demand. In this example, using sublimation process, transfer papers 30 sized appropriate to these additional live areas 40 are used to print thereto in like manner as previously described. It should be understood that the scope of the method herein contemplated readily covers production of textile articles with live areas 20 disposed wherever customary or desirable for additional design elements to be added to the finished textile article, including, for example, to towels, beach towels, hats, cushions, pillows, throws, as well as other clothing articles, garments, and textiles.

Figure 8:
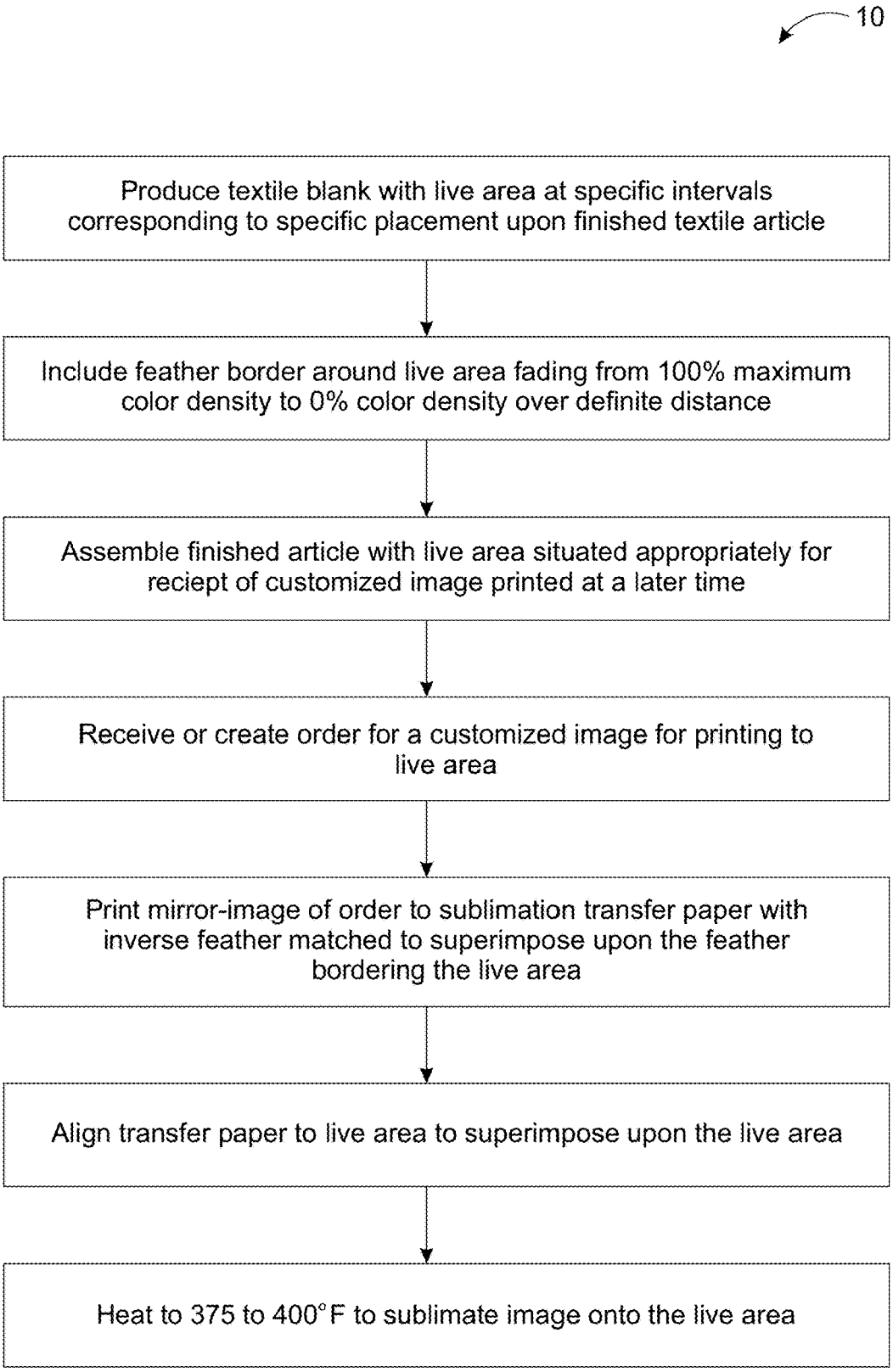
FIG. 8 is a flow diagram illustrating the steps of the method of mass producing garments having live areas to which customized or unique design elements may be added individually upon demand.

FIG. 8 illustrates a flow diagram outlining the steps of the present method 10 whereby textile blanks 100 are producible in bulk to render finished articles with live areas 20 appropriate for the addition of customized or unique designs upon demand and at appreciable cost savings.

Figure 9:
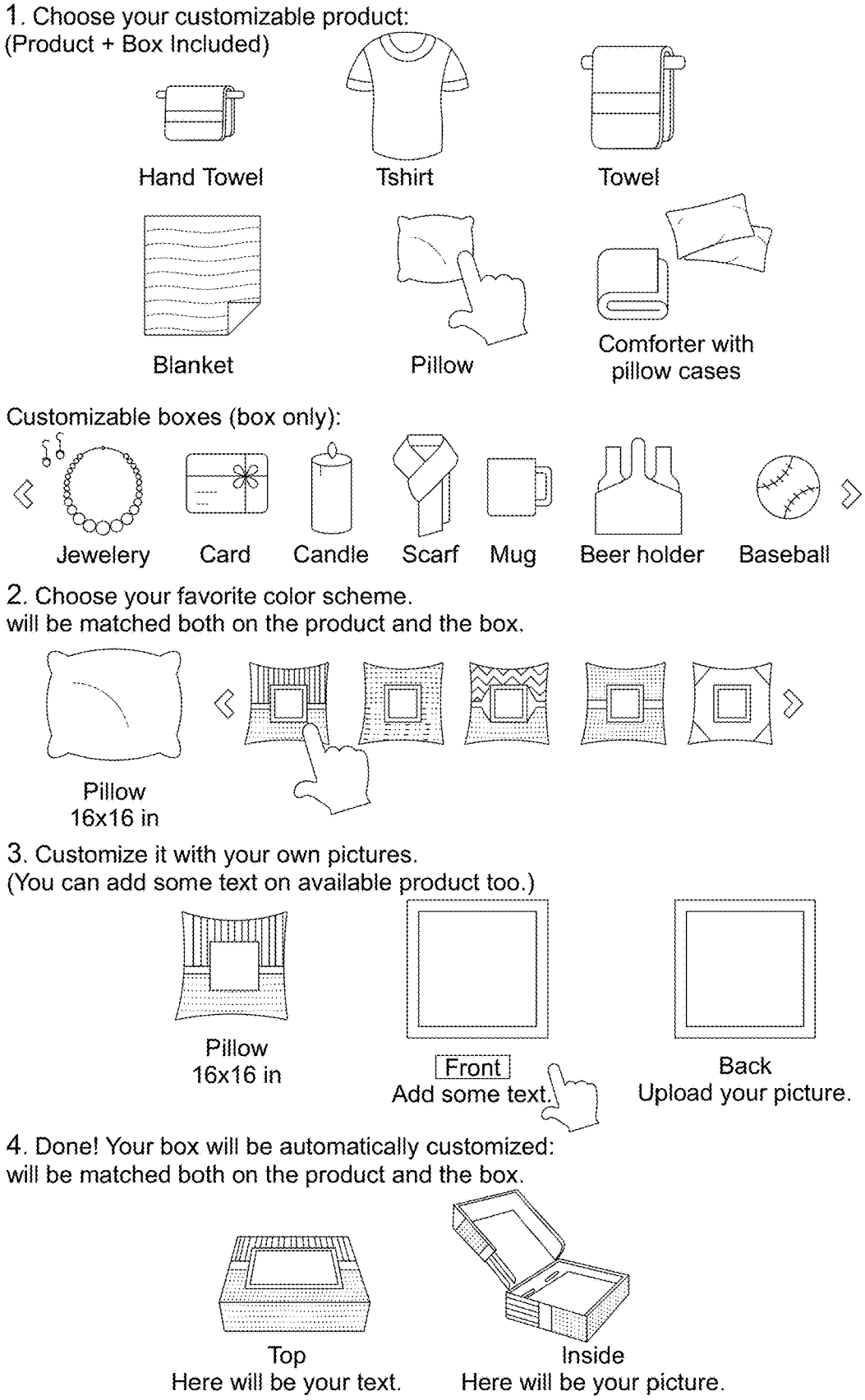
FIG. 9 is a diagram illustrating an example of a customer ordering a customized textile article online.

FIG. 9 illustrates an example method of ordering a customized textile article online in use of the present method. A customer is enabled to load an image to a live area 20 disposed upon a textile article 70, as desired. The article 70 is thence customized by printing to the live area 20 in the manner described herein. Because the live area 20 is a known size, images can be manipulated electronically to fit the live area 20 and also incorporated into other articles (including, as shown here, the packaging 72 with which the article 70 will be shipped). Transition between the background of the image applied and the surrounding textile article 70 are maintained at matched color densities by means of the method herein described. Thus, a customized, unique, or individual textile article 70 is producible upon demand at minimal expense. The textile articles 70 are producible in bulk. The image printed to the live area 20 can be sublimated thereto by printing to the correspondingly sized transfer paper without the need of expensive printers capable of printing to larger items or directly to textile articles. Application of the requisite heat to the paper in position superimposed upon the live area 20 transfers the image to the live area 20, binding the color into the textile weave, penetration the fiber as a sublimated gas, for a longer-lasting color.

Figure 10:
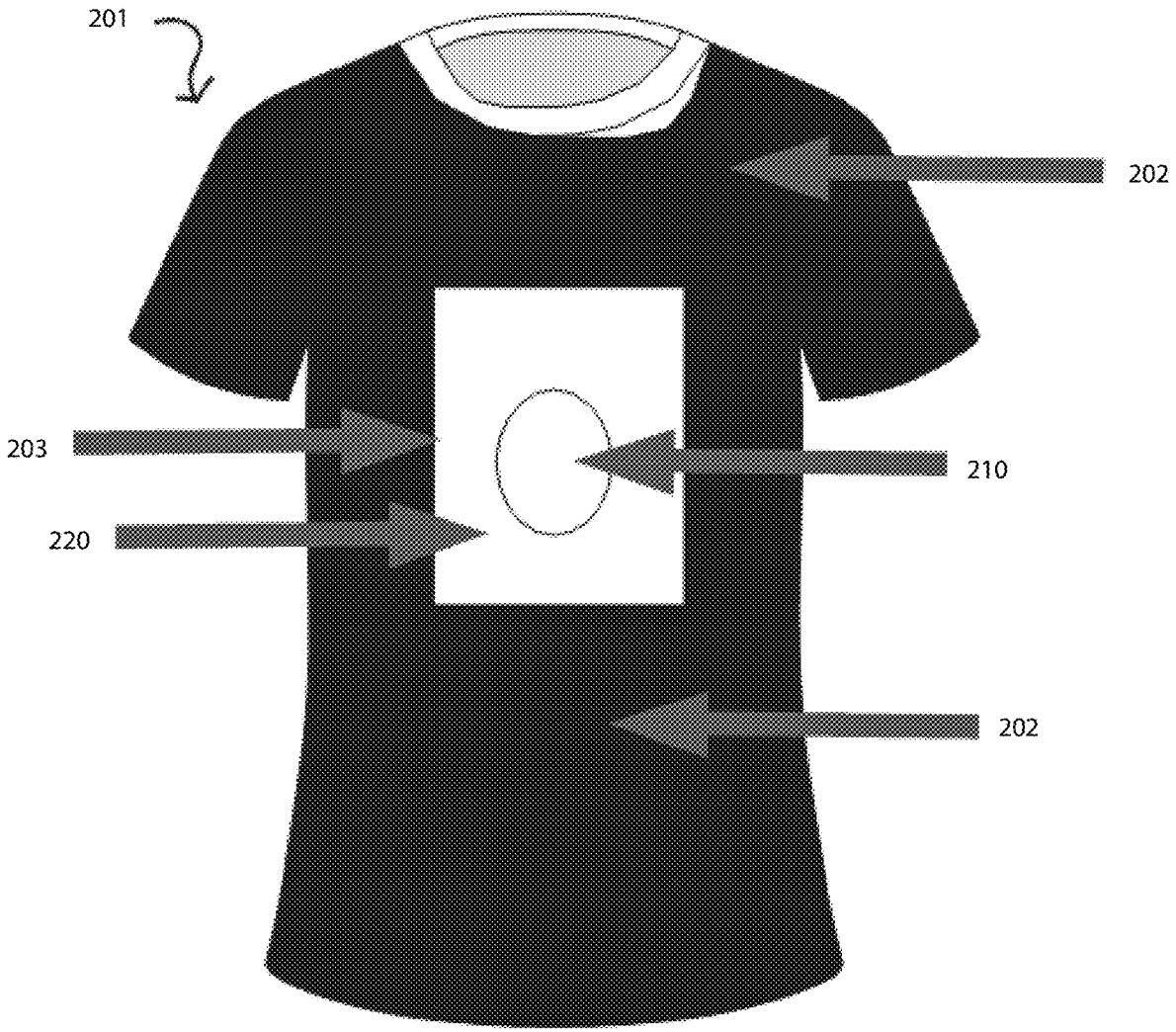
Figure 11:
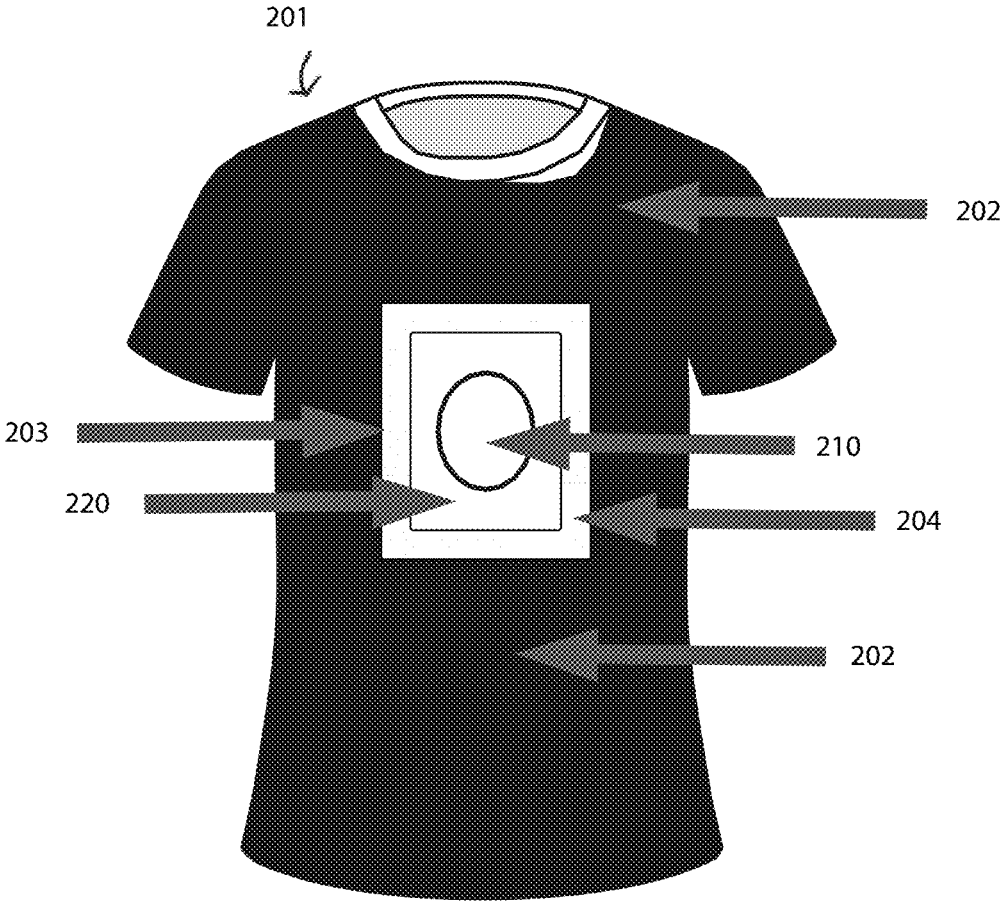
Figure 12:
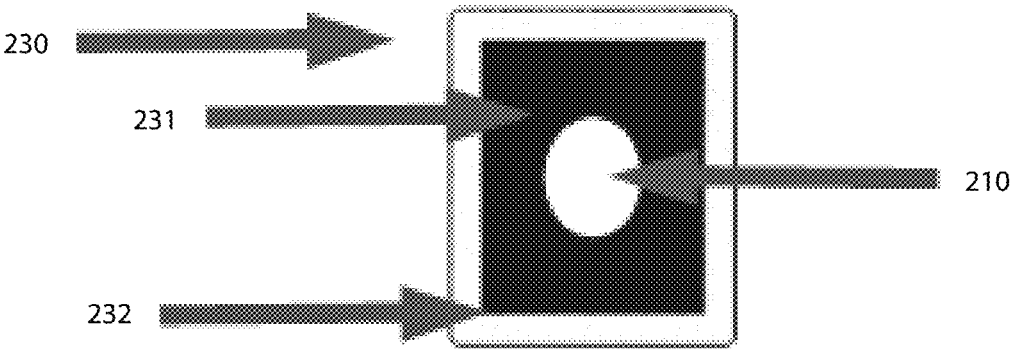

FIGS. 10-12 illustrate an example embodiment of generating a textile article having novel color matching characteristics. For example, in this embodiment, the invention provides methods for printing an image or design on the surface of an article 202, preferably a textile or garment made predominantly of polyester or other dye sublimation receptive synthetic fabric with a pattern that includes a live area 220 as described above, defined by a border 203. As shown in FIG. 12, the inside portion of the border 204 may include a feathered border that overlaps with the live area 220 and has the same color at a higher CIELAB L* value than the article 202. The live area 220 may be printed using dye sublimation in to transfer an image or design 210 into the live area 220. As shown in FIG. 12, the image or design 210 may be include an imposed background 231, and preferably a background that is the same color as the article 202 and sized such that it surrounds the custom image or design 210 printed to the live area 220. In this preferred embodiment, the border of the background 231 may be sized so that it is approximately the same size as the opening defined by border 203 of the live area 220.

Again, as shown in FIG. 11, the background 231 may be surrounded by an area that is the same color as feathered border 204 of the live area 220. In this embodiment, the final printed article may appear to blend so that the fact that the article was printed in two steps will not be readily discernible. As noted above, in an example embodiment described herein, a textile blanks 201 may be rendered at a color lightness (CIELAB L*) of black which is slightly greater than the tolerance level afforded by digital sublimation and required to ensure a match of the sublimated image subsequently applied to the live area. For example, as highlighted in FIG. 12, matching the color of the background 232 of an image or design, and preferably a black background of a sublimated image or design to the color of the textile blanks 201 of the garment may be achieved. Color matches for dark colors require tight tolerances that are not captured accurately by unadjusted Euclidean distance between colors that are contemplated in the CIELAB Delta E* (ΔE*) 1976 formula or any subsequent revisions.

As used herein, CIELAB Color describes the tristimulus color scale based on CIE 1976 standard, containing a lightness (L*), red-green (a*) and yellow-blue (b*) term; the total color difference is calculated from the CIE 1976 L*a*b* opponent-color scales, and is denoted as ΔE*. CIE Chroma, the attribute of color used to indicate the degree of departure of the color from a gray of the same lightness; the chroma difference is calculated by using the CIE 1976 a*b* opponent-color scales, denoted as ΔC*. CIE Hue, the attribute of color perception by means of which a color is judged to be red, orange, yellow, green, blue, purple, or intermediate color; the hue difference is calculated by using the CIE 1976 a*b* opponent-color scales, denoted as ΔH*

Consequently, in a preferred embodiment, ΔE, ΔL*, Δa*, Δb* are used in successive order matching the color of the background 320 to the color of the textile blanks 201. In this embodiment:

ΔE* refers to CIELAB;

ΔL* refers to the difference between the L* value of the body to the background;

Δa* refers to the difference between the a* value of the body to the background; and Δb* refers to the difference between the b* value of the body to the background.

Referring again to FIG. 12, in this embodiment, the background 232 of the image or design compared to the textile blank 201 may include the following parameters:

ΔE is less than 1.00;

ΔL* is less than 0.50;

Δa* is less than 0.50 and a* of both areas are either positive or negative; and

Δb* is less than 0.50 and b* both areas are either positive or negative.

In another embodiment, the blank article may be black, and preferably a color black having an L* value between 18-24, which a sublimated image may have a black background or other element that is black with an L* value of a minimum of 20. An example of a black color specification is PANTONE 19-4005TCX used as black for the black T-shirt manufactured and sold by the Gildan textile company, 600 de Maisonneuve West, 33rd Floor, Montreal (Quebec), H3A 3J2 Canada. This color also corresponds in the CMYK Color Model of 100-35-0-100 wherein CMYK is defined as C for cyan, M for magenta, Y for yellow, and K is key for black where the four color ink set meets the ISO 2846-1:2017 standard and the media on which the ink is printed is isotropic. The CMYK ISO standard is ISO 12640-1:1997 and can be accessed at iso.org.

Notably, for applications of the current invention that incorporate sublimation image transfer onto a textile, in one preferred embodiment the textile maybe formed by a material configured to accept sublimation dyes more readily. For example, in some embodiments a high-heat extruded material, such as a heat extruded yarn, may be formed into a textile and used with the invention. In this embodiment, the extruded material may further include a denier count of approximately 1, but no more then 1.2, and may further include a fiber tenacity of approximately 3.5.

Notably, the term "sublimation dye(s)" is used throughout this description and in the claims and refer to a colored substance that has an affinity to a substrate and is applied to the substrate via sublimation printing. The colored substance may be derived from plant or synthetic sources that may be finely ground and included with a dispersing agent. The sublimation dye may infuse into the substrate at the molecular level and impregnate color into a material. Moreover, "sublimation dye" may be utilized in accordance with aspects provided herein to be absorbed by a live area, and it is to be understood that any aspects, definitions, or descriptions related to a "sublimation dye" are also applicable to utilization of a "sublimation dye" in connection with methods for printing a garment and as a component of a garment. Additional aspects relate to a sublimation dye having a color component, which may be afforded by colorants, and a sublimation dye may be configured to be of any color including red, orange, yellow, green, blue, indigo, violet, shades thereof. It is further contemplated that a color component of a sublimation dye may be imparted to a live area and/or at least a portion of a live area or a garment.

As previously stated, aspects herein relate to a live area that may form at least a portion of a garment, and as such, a live area may be any textile or cloth material formed of natural or artificial fibers, and a preferably a textile or cloth material manufactured from heat-extrusion. Moreover, it is contemplated herein that a live area may be formed by traditional methods such as weaving, knitting, crocheting, knotting, felting, and the like. In aspects, a material of a live area is configured to interact with an ink and a sublimation dye such that a high quality graphic, design, image, or visual indicia may be printed on the live area. Additionally, a live area, or overall garment, may comprise one or more materials that are suitable for or provide desirable characteristics to a specific garment including breathable materials, wicking fabrics, stabilizing components, and/or elastic elements for comfort and/or tailoring a fit of a garment. As such, a live area, or garment may comprise polyester, nylon, cotton, spandex, rayon, cellulose, and blends thereof. In aspects, these materials may be included in a live area, or garment in certain amounts, and for example, a live area, or garment may comprise a blend of materials. These aspects include a live area, or garment formed from a material that comprises at least 50% polyester, and thus, a composition of fibers that form the material may include at least 50% polyester fibers. Such aspects further contemplate using a performance fabric or a polyester blend fabric to form a live area, or garment, both of which include at least 50% polyester and provide performance characteristics for garments designed to be worn by a wearer participating in athletic activities. In some aspects, a live area, or garment may be composed of 75% polyester and 25% cellulose, cotton, and rayon; 50% polyester and 50% cellulose; or 100% polyester. As discussed, aspects relate to employing an ink and a sublimation dye to print a garment having a live area that comprises at least 50% polyester. Moreover, these components may have varying properties and characteristics, which may cause the components to interact with one another in different manners. As such, certain combinations of an ink, sublimation dye, and polyester content of a material may be adjusted to produce a print on a garment with certain characteristics.

One such characteristic is the color of an image or color. In aspects herein, color saturation relates to an intensity of colors in an image. The term "color saturation" is more technically defined by the International Commission on Illumination (Commission internationale de l'éclairage; CIE), the international authority on light, illumination, color, and color spaces. The CIE's definition of "color saturation" is the colorfulness of an area judged in proportion to its brightness. The entirety of the of CIE is incorporated by reference herein, and for explanatory purposes, color saturation is more broadly discussed below. At a high level, color saturation may refer to an intensity or purity of color in an image. For example, an image with a low color saturation will include visible gray tones and may appear muted, whereas an image with high color saturation will include vibrant colors and no gray tones will be visible. While this generalized explanation of color saturation is relevant to understanding aspects discussed herein, the term "color saturation" shall be considered in a context of an image, print, graphic, and/or visual indicia on a live area or garment, and relate to printed areas of a live area or garment that may have different color saturations.

Notwithstanding, a color saturation of an image involves a visual perception and therefore, measuring color saturation may involve a subjective component and may differ depending on certain conditions. As such, the term "color" or "color saturation" as used throughout with respect to the application of a design or image through sublimation or other printing methods refers to a characteristic of color at an area of a live area and/or after application of a sublimation dye and/or to a portion of a surface of the garment in accordance with aspects discussed herein. Further, more intense colors may correspond to a higher color saturation, and less intense colors may correspond to a lower color saturation. As such, areas of a live area that have different color intensities may have different color saturations. Additionally, as noted above, differences in "color saturation" may be defined as a numerical comparison of one or more color saturations that are determined by differences between color saturations of one or more samples to a standard color saturation, which may further be indicated by differences in absolute color coordinates referred to as Delta (Δ).

In further aspects and as understood by those having ordinary skill in the art, a color measurement instrument, such as a spectrophotometer, may be used to measure color saturation of one or more color samples by assigning one or more numerical values, each of which are associated with a characteristic of a color sample and may collectively be used to calculate a differences between color saturation of the one or more samples. As such, it is contemplated that differences between color saturation at different areas on a surface of a live area or garment may be evaluated by measuring the color saturation at each of the different areas of the live area with a spectrophotometer, calculating a difference between numerical values associated with the color saturation at each different area with standard numerical values, and then comparing the calculated differences of each different area on the surface of the live area or garment with one another.

As also noted above, in one example, a difference in color saturation may be identified using the L*a*b* color space as defined by the CIE (Color Science: Concepts and Methods, Quantitative Data and Formulae—Gunther Wyszecki & W S Stiles. Wiley. ISBN: 0471399183.) In this example, L* represents lightness/darkness, a* represents the red to green axis coordinate, and b* represents a yellow to blue axis coordinate. An L* value of 0 represents perfect black and an L* value of 0 represents perfect white. The a* and b* axes can be calculated using different scales; in this case a scale of −128 to +128 is assumed. The a* axis is defined with green at −128 and red at +128. The b* axis is defined as blue at −128 to yellow at +128. Moreover, a spectrophotometer may be implemented to measure the L*, a*, and b* values of a live area or garment. As previously mentioned, a difference between the standard and sample L*, a*, and b* values of the live area and the underlying garment textile, respectively, may be referred to as Delta (Δ), and a comparison of these differences at each area may represent differences in color saturations between the standard live area and the sample live area at their respective first area or their respective second areas. Furthermore, as a color saturation may relate to an amount of sublimation dye absorbed at a live area of a garment printed in accordance with aspects herein, color saturation may be affected by a polyurethane-based ink, non-polyurethane-based ink, and a polyester content of a material that forms the garment.

What is claimed is:

1. A method for live area printing for textiles comprising the steps of:

manufacturing a textile blank with white or uncolored live areas disposed at intervals set to present the live area in a specific location upon a finished textile article manufactured from the said textile blank; and printing a design or image upon the live area having a background color matched to the textile blank;

wherein said textile blank comprises a textile blank having a color equal to or greater than the minimum color density or saturation lightness achievable by sublimation printing, and wherein the color differential optionally comprises a color differential of no more than one E*.

2. The method of claim 1, wherein printing comprises printing a design or image upon the live area in single print run without the addition of a previously applied overlay required to set-off the ink.

3. The method of claim 1, further comprising wherein additional substances to bind, set, disburse, and/or contrast ink to the textile article are unnecessary and customizable imagery or designs having a background color matched to the textile blank can be reproduced upon the textile blank live area on demand.

4. The method of claim 1, wherein said printing a design or image upon the live area comprises printing a design or image upon the live area by sublimation.

5. The method of claim 1, wherein the background of the design or image printed on the live area by sublimation compared to the textile blank includes the following parameters:

CIELAB ΔE* is less than 1.00;

ΔL* is less than 0.50;

Δa* is less than 0.50 and a* of both areas are positive; and

Δb* is less than 0.50 and b* is negative.

6. The method of claim 1, wherein said textile blank comprises a black textile blank having a black with CIELAB L* value equal to or greater than the minimum CIELAB L* achievable by sublimation printing.

7. The method of claim 6, wherein said black textile blank comprises a black textile blank having a L* value greater than the L* value for the color black achievable by sublimation.

8. The method of claim 6, herein said black textile blank comprises a black textile blank having an L* value of 17 to 24.

9. The method of claim 6, herein said black textile blank comprises a black textile blank having a live area that is digitally printed utilizing sublimation having an L* value between 17-24.

10. The method of claim 1, further comprising the steps of:

producing said live area upon the textile blank with a feathered border having a fade from a minimum color lightness (L*), corresponding to the color lightness of the textile blank, to a L* of 100;

printing the image to the live area with an inverse feathered border configured to superimpose upon the feathered border of said live area, wherein an inverse fade superimposes upon the feathered border of the textile article to ensure a constant color lightness (L*) is maintained across the transition between said live area and the textile article; and whereby the background color of the live area is matched to the color of the textile article and the lightness of the color is equalized across the transition between the textile article and the live area.

11. The method of claim 10, wherein printing to said live area is performed by sublimation printing wherein a mirror-image of the design is first printed to a sublimation transfer paper sized to superimpose upon the live area.

12. The method of claim 10, wherein the minimum color lightness applied to the textile blank is equal to or greater than the minimum color lightness achievable by sublimation printing, and wherein the color differential optionally comprises a color differential of no more than one ΔE*.

13. The method of claim 10, wherein the feathered border of the live area is matched with an inverse feathered border printed upon the sublimation transfer paper whereby the of a background of the live area is matched to the color of the textile blank upon sublimation of the printed design or image as measured by ΔL*, Δa* and Δb*.

14. A method for live area printing for textiles comprising the steps of:

producing a colored textile blank with at least one white or uncolored live area, said live area configured to specific dimensions matched to a live area digital print module operating upon a digital ink jet printer or sized to a corresponding transfer paper for sublimation printing;

producing the finished textile article from the blank such that the at least one live area is presented upon the textile article at a desired location for addition of a design or image printed onto the at least one live area at a subsequent time; and printing a design or image directly onto the at least one live area in a single print run with a background color matched to the color surrounding the live area on the textile article without the need of additional substances applied to the textile to set the ink in contrast during the said print run.

15. The method of claim 14, further comprising the step of producing the live area upon the textile blank with a feathered border having a fade from a minimum color lightness, corresponding to the color lightness of the textile blank, to a lightness value L* of 100.

16. The method of claim 15, further comprising the step of printing a design or image to the live area with an inverse feathered border devised to superimpose upon the feathered border of the live area, wherein an inverse fade superimposes upon the feathered border of the textile article to ensure a constant color lightness is maintained across the transition between the live area and the textile article whereby the background color of the live area is matched to the color of the textile article and the lightness of the color is equalized to create a seamless transition between the textile article and the live area.

17. The method of claim 16, wherein the step of printing a design or image to the live area further includes the steps of:

printing the design or image in mirror-image to a sublimation transfer paper sized to superimpose over the at least one live area;

positioning the sublimation transfer paper superimposed upon the live area wherein the inverse feathered border of the transfer paper superimposes upon the feathered border of the live area to maintain a constant color lightness across the superimposed feathered borders; and applying heat to sublimate the design or image from the transfer paper into a weave of the live area.

18. The method of claim 14, wherein the minimum color lightness applied to the textile blank is equal to or greater than the minimum color lightness achievable by sublimation printing, and wherein the color differential optionally comprises a color differential of no more than one ΔE*.

19. The method of claim 14, wherein the background of the design or image printed on the live area by sublimation compared to the textile blank includes the following parameters:

ΔE* is less than 1.00;

ΔL* is less than 0.50;

Δa* is less than 0.50 and a* of both areas are positive; and

Δb* is less than 0.50 and b* is negative.

20. The method of claim 14, wherein said textile blank comprises a black textile blank having a black color lightness equal to or greater than the minimum black color lightness achievable by sublimation printing.

21. The method of claim 20, wherein said black textile blank comprises a black textile blank having a CIELAB L* value less than CIELAB L* level for the color black achievable by sublimation.

* * * * *